United States Patent [19]

Rossi et al.

[11] Patent Number: 4,613,243

[45] Date of Patent: Sep. 23, 1986

[54] WIRE MATRIX PRINTER WITH DAMPING MEANS

[75] Inventors: Mario Rossi, Gallarate; Angelo Gaboardi, Pregnana Milanese, both of Italy

[73] Assignee: Honeywell Information Systems Italia, Milan, Italy

[21] Appl. No.: 650,472

[22] Filed: Sep. 14, 1984

[30] Foreign Application Priority Data

Sep. 27, 1983 [IT] Italy ..... 23004 A/83

[51] Int. Cl.[4] ..... B41J 3/10

[52] U.S. Cl. ..... 400/124; 101/93.05; 101/93.02; 400/167

[58] Field of Search ..... 400/124, 167; 101/93.02, 93.04, 93.05

[56] References Cited

U.S. PATENT DOCUMENTS

| | | | |
|---|---|---|---|
| 3,896,918 | 7/1975 | Schneider | 400/124 |
| 4,202,638 | 5/1980 | Stenudd | 101/93.02 |
| 4,272,748 | 6/1981 | Fugate et al. | 400/124 |
| 4,367,962 | 1/1983 | Gaboardi | 400/124 |

FOREIGN PATENT DOCUMENTS

| | | | |
|---|---|---|---|
| 56-58883 | 5/1981 | Japan | 400/124 |
| 56-164874 | 12/1981 | Japan | 400/124 |
| 57-61588 | 4/1982 | Japan | 400/124 |
| 57-61589 | 4/1982 | Japan | 400/124 |
| 57-126672 | 8/1982 | Japan | 400/124 |
| 57-173179 | 10/1982 | Japan | 400/124 |
| 57-203566 | 12/1982 | Japan | 400/124 |
| 57-207072 | 12/1982 | Japan | 400/124 |
| 58-45964 | 3/1983 | Japan | 400/124 |

OTHER PUBLICATIONS

"Multi-Impact Backstop for Print Hammer"; S. Mitrovich; *Xerox Disclosure Journal;* vol. 1, No. 4, p. 21; Apr. 1976.

"Impact Printer Missile with Minimal Rebound"; R. Wustrau; *IBM Technical Disclosure Journal;* vol. 23, No. 7B, p. 3079; Dec. 1980.

*Primary Examiner*—Edgar S. Burr
*Assistant Examiner*—David A. Wiecking
*Attorney, Agent, or Firm*—Nicholas Prasinos; John S. Solakian

[57] ABSTRACT

Electromagnetic printing group for a dot matrix printer where the armature movement towards the rest position isdamped by a counterarmature interposed between the armature and a resilient element defining the rest position so that the air cushion interposed between counterarmature and armature provides a first damping action followed by the damping caused by the ballistic impact between armature and counterarmature and finally by the resilient damping of the residual energy of the armature and counterarmature.

3 Claims, 3 Drawing Figures

WIRE MATRIX PRINTER WITH DAMPING MEANS

BACKGROUND OF THE INVENTION

1. Field of the Invention

The present invention relates to an electromagnetic printing group for a dot matrix printer.

2. Description of the Prior Art

In the dot matrix printers used in the data processing systems, printing is performed by needles or dot printing elements impinging on a printing support. Movement of the needles towards and away from the printing support is caused by printing electromagnets. Movable armature electromagnets of the attraction or release type are generally used.

There are three timing phases in the operation of the actuators. For the attraction electromagnets the phases are as follows:

(A) Energization or impact phase (B) Return phase (C) Damping phase.

During the energization phase the electromagnet winding is energized and the movable armature is drawn towards the electromagnetic core. The armature movement causes the movement of a printing needle towards the printing support.

During the return phase the winding is de-energized and the movable armature reverses and returns to its rest position together with the printing needle.

During the damping phase, the movable armature reaches the rest position with a certain speed then interacts with a damping element and assumes a stable rest position with oscillations becoming smaller as the damping action becomes more effective.

The release electromagnet operation also is performed during three timing phases, the last of which is a damping phase. Accordingly effective damping is essential in order to obtain high printing speed performance.

In order to obtain repeatable performance from a printing electromagnet, it is necessary that each time the electromagnet is energized the movable armature is in its rest position. Therefore a printing electromagnet can be energized again only when the damping phase is completed. The maximum actuation frequency of a printing electromagnet is greatly limited by the damping phase duration. Generally the damping of the armature movement is obtained by resilient elements, generally associated to calibration means as disclosed, for example, in U.S. Pat. No. 4,367,962. Among the resilient materials fluoroelastomers are largely used which have high internal viscosity coefficient and therefore develop high damping action. However such damping action is largely affected by the working temperature; at 50° the internal viscosity is greatly reduced. Consequently the dynamic characteristics of the electromagnetic group are negatively affected by the temperature.

Another way to obtain damping action is disclosed in U.S. Pat. No. 4,202,638. This document discloses a pneumatic dampener avoiding the armature bounce in releasing an electromagnet, during the armature return to the rest position. In this case a rigid plate is arranged on the magnetic core poles and the armature, in rest position, lies against such a plate. During the return phase of the armature towards the rest position, the air cushion between the armature and the plate dampens the armature movement and reduces the bounce. This patent indicates that the invention further applies to the attraction type electromagnets. This kind of dampener is not affected by the temperature but is only partially effective.

These undesirable effects are overcome by the present invention where effective and fast damping is obtained by combining the effects of the resilient and pneumatic damping together with a ballistic coupling which enhances the effects and substantially eliminates the armature oscillations.

OBJECTS OF THE INVENTION

It is a primary object of the invention therefore to provide an improved dot matrix printer.

A further object of the invention is to provide improved damping for the printing elements of a dot matrix printer.

SUMMARY OF THE INVENTION

These objects are achieved by the use of an electromagnetic structure comprising a movable armature, a movable plate or counterarmature and a damping resilient element. Briefly the return of the armature to the rest position is dampened by the air cushion between armature and counterarmature; accordingly the residual kinetic energy of the armature is completely or almost completely transferred to the counterarmature and the kinetic energy so possessed by the counterarmature is absorbed by the resilient element.

BRIEF DESCRIPTION OF THE DRAWINGS

The novel features of the invention and its advantages will appear clearer from the following description of a preferred embodiment of the invention and from the enclosed drawings where.

DESCRIPTION OF THE PREFERRED EMBODIMENT

Figure 1:
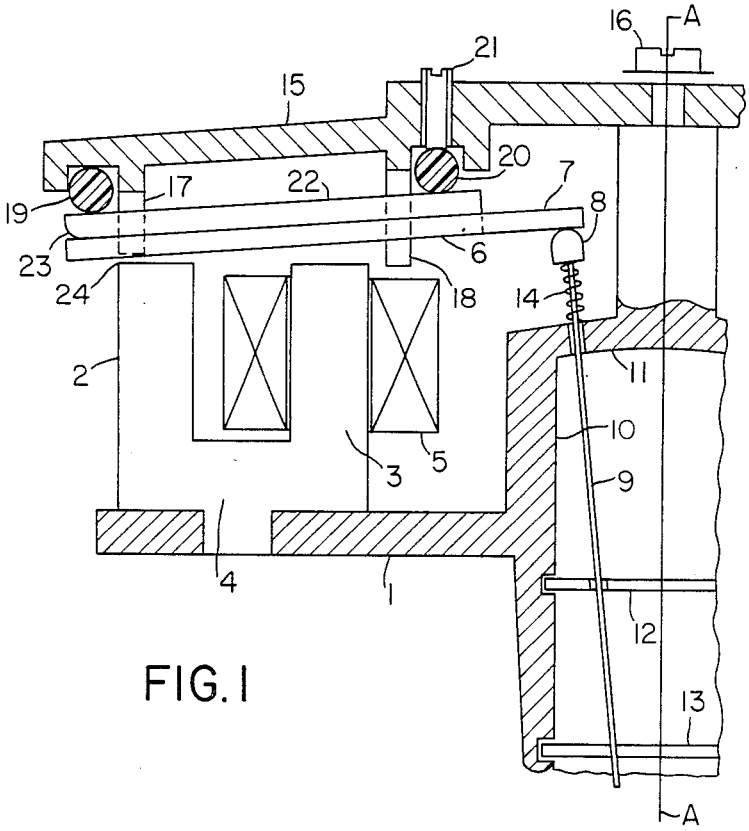
FIG. 1 partially shows in section a needle printing head including an electromagnetic printing group embodied according to the present invention.

FIG. 1 partially shows in section a needle printing head including an electromagnetic printing group embodied according to the invention. The general construction of such printing head is similar to the ones disclosed, for example, in the already-mentioned U.S. patent and comprises a support element 1 supporting the electromagnets and the needles. Support element 1 is a plane which is ring shaped with the ring having axis A—A. On the ring, n magnetic cores are mounted, radially arranged around axis A—A, each core comprising two columns 2, 3 and a yoke 4. In FIG. 1 only one of n magnetic cores is shown. An electrical winding 5 is arranged around a core column 3. A plate shaped movable armature 6 having two opposed flat main surfaces is positioned on the top of columns 2 and 3 by means of a retainer and extends with one main surface over the top of columns 2 and 3 and the gap therein. The movable armature radially protrudes towards axis A—A with an arm 7, against which head 8 of an impression needle 9 lays. Support element 1 is provided with a central bushing 10, which is hollow and drilled at the top in order to enable needle 9 to pass through. Drilled guiding needle diaphragms 12, 13 are arranged inside bushing 10. A coil spring 14, wound around needle 9 acts between the upper face of bushing top 11 and needle head 8 and pushes the needle head against arm 7. A ring retainer 15 of the armatures, such as armature 6, is suitably fixed by means of screw 16 to bushing 10. Retainer 15 is provided with suitable teeth 17, 18 which assure the radial positioning of the armature 6. Retainer 15 is further provided with two circular grooves housing two resilient rings (O-RING) 19, 20 respectively. The O-RING 20 position in the groove can be adjusted to correspond with the several armatures by means of screws; e.g. screw 21 of FIG. 1 corresponds to armature 6. The function of O-RING 19 and 20 is the rest position bias and defines the rest position of the several armatures. In the case of conventional printing heads, O-RING 19 acts on armature 6 pressing the armature end against the uppermost part of column 2. The torque exerted by O-RING 19 and the torque exerted by spring 14 (through head 8) on arm 7, tends to keep the armature in rest position; against O-RING 20 and separated from the top of column 3 by an air gap. The structure described so far is conventional and is equivalent to the one disclosed in the above-mentioned U.S. patent.

However it should be noted that in FIG. 1, O-RINGS 19 and 20 do not directly act on armature 6 and this is the characteristic feature of the invention, where a counterarmature 22, shaped as a rigid plate in non-magnetic material having a plane surface and pivotable independently from armature 6, is interposed between O-RINGS 19, 20 and armature 6. The counterarmature is suitably shaped as armature 6, though without the arm corresponding to arm 7, and is kept in a radial position by teeth 17 and 18. End 23 of counterarmature 22 is slightly rounded in order to allow a slight relative rotation between armature and counterarmature in the section plane of FIG. 1 and without interference between the elements. In other words, counterarmature 22 is pivotable at around end 23 that is very close to around pivot axis 24 of armature 6 independently from it. The advantages obtained from the addition of such counterarmature will further become obvious upon the reading of the disclosure infra.

FIG. 1 shows needle 9, armature 6 and counterarmature 22 in rest position. In rest position the counterarmature lays on O-RINGS 19, 20 and is pressed against them. The upper side of armature 6 contacts the lower side of counterarmature 22. When winding 5 is energized the core becomes magnetized and armature 6 rotates around point 24 to assure the attracted position. Counterarmature is not attracted and therefore it does not follows the armature movement. The air depression produced between armature and counterarmature tends to recall the counterarmature and have it follow the same armature movement. Such rotation is, however, opposed by the action of O-RING 19 so that the counterarmature undergoes only inperceptible shifts. When the electromagnet is de-energized armature 6 tends to return to its rest position because of the torque of spring 14 and O-RING 19, as well as the bounce caused by the impact with the printing support or with the magnetic core or both. The compressed air cushion between armature and counterarmature tends to brake armature 6 damping its kinetic energy. In this phase also the pressure because of the air cushion on the counterarmature opposed by the O-RING 20 action, causes only imperceptible shifts of the counterarmature from the rest position. Finally, when armature 6 reaches its rest position and the upper side of armature 6 contacts the lower side of counterarmature 22 an impact takes place between the elements, and if their mass is equal, the residual kinetic energy is totally transferred to counterarmature 22. Armature 6 stops in its rest position; while the counterarmature tends to leave the rest position pressing O-RING 20l. (It is to be noted that during the ballistic impact the energy transfer from a body to another one without dissipation is obtained only in the ideal case of perfectly elastic bodies and that, practically, a certain dissipation always occur.) Therefore it may be concluded that the damping of armature 6 of the invention electromagnetic group is obtained through the combined use of the following mechanisms:

(A) pneumatic damping (B) impact damping (C) resilient damping.

The kinetic energy fraction to be dissipated by the resilient damper is limited to the residual one. So the variation of the resilient characteristics of the resilient mean according to temperature variations affect the dynamic behavior of the electromagnetic group only slightly. An extremely repeatable performance is therefore obtained in the armature movement with greatly reduced damping time. Theoretically, the counterarmature mass cannot be greater than the equivalent armature mass to avoid armature bounces. Practically such choice is not fixed and any ratio between counterarmature and armature mass ranging from 0.5 to 1.2 offer appreciable advantages, with a maximum for the ratios ranging from 0.8 to 1.

Figure 2:
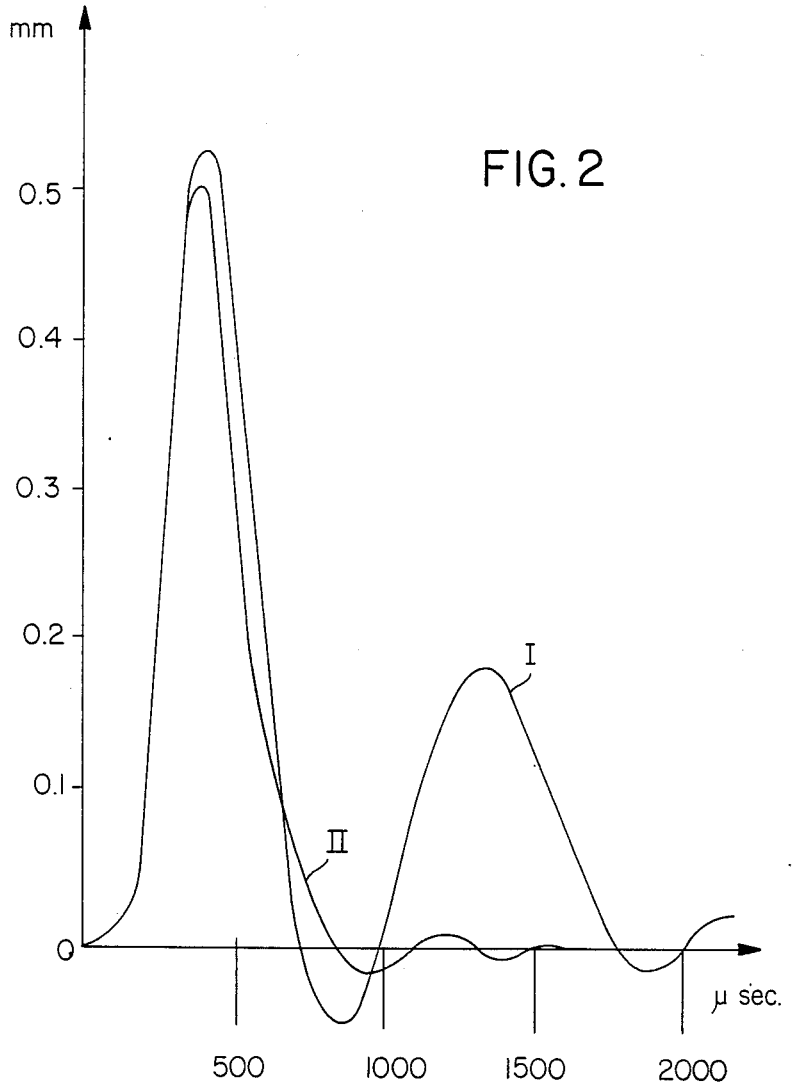
FIG. 2 shows a comparative timing diagram of the operation of an electromagnetic group embodied according to the invention as opposed to the operation of a conventional electromagnetic group.

FIG. 2 shows a comparative diagram of the behaviour of a conventional electromagnetic group with resilient damping (diagram I) and of an electromagnetic group embodied according to the invention (diagram II) where the counterarmature is obtained from an armature which does not have arm 7 therefore with a weight reduction of about 15%. The actuation time in μsec. is shown as an abscissa and the needle end travel as to the rest position, in mm, is shown as an ordinate. It should be noted that, in the case of a conventional electromagnetic group, the total actuation time is about 2 msec., while, in the case of the electromagnetic group embodied according to the invention, the residual oscillations are negligible after the first millisecond and of a lower order of magnitude. Accordingly during the energization phase, the needle movement is not affected in an appreciable way.

Although FIG. 1 shows an electromagnetic group where the armature operates according to a level system of the 3rd kind (fulcrum-power-resistance). It is however clear that the invention can be applied, with obvious modifications, to different cases too.

Figure 3:
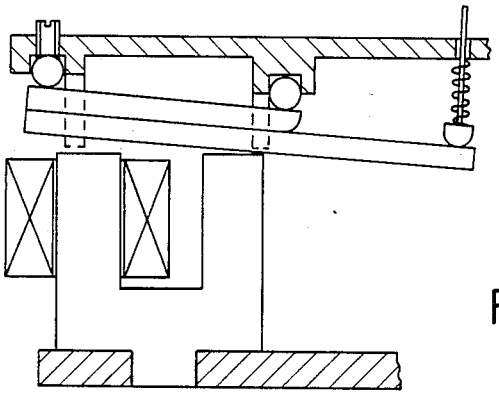
FIG. 3 schematically shows a variant of the electromagnetic group embodied according to the present invention.

FIG. 3 shows, without reference numbers—which are not essential, the application of the invention to an electromagnetic group where the armature acts according to a lever system of the 1st type (power-fulcrum-resistance). It is further clear that the positioning and damping elements shown by O-RING 19, 20 can be comprised of any other kind of elements performing the same function, such as leaf or coil springs for O-RING 19 and damping bearings for O-RING 20.

What is claimed is:

1. A printing electromagnet group for a dot matrix printer of the kind where a plate shaped movable armature having first and second opposed flat surfaces is attracted by a magnetic core magnetized by a current flowing in an energization circuit and returns to a rest position because of biasing forces applied on said armature, the armature movement being capable of pivoting on a pivotal axis located on the first of said surfaces, a resilient element defining the rest position of said armature and determining the damping of the said armature when said armature contacts said damping means, said damping means comprising a resilient element and:

a non-magnetic plate shaped counterarmature interposed between said armature and said element, said counterarmature having a contact surface with said second surface of said armature and with the full extent of said second surface when said armature is in rest position, said non-magnetic plate shaped counterarmature being pivotable independently from said armature on a pivotal axis located on said second surface and close to the pivotal axis of said armature.

2. An electromagnetic group as per claim 1 characterized in that the group comprises elastic return means maintaining both said armature and said counterarmature in rest position.

3. An electromagnetic group as per claim 1 characterized in that said counterarmature has a mass substantially equal to said armature mass.

* * * * *